US005808970A

United States Patent [19]

Nussbaum et al.

[11] Patent Number: 5,808,970

[45] Date of Patent: Sep. 15, 1998

[54] MULTI-LAYER ACOUSTICALLY TRANSPARENT SONAR ARRAY

[75] Inventors: Fred Nussbaum, Middletown; Gerald T. Stevens, Portsmouth; Maurice J. Griffin, Tiverton, all of R.I.

[73] Assignee: The United Stated of America as represented by the Secretary of the Navy, Washington, D.C.

[21] Appl. No.: 869,723

[22] Filed: Jun. 5, 1997

[51] Int. Cl.[6] ..... H04R 17/00

[52] U.S. Cl. ..... 367/153; 367/155; 367/158; 310/337

[58] Field of Search ..... 367/153, 155, 367/158, 159; 310/337, 334

[56] References Cited

U.S. PATENT DOCUMENTS

| | | | |
|---|---|---|---|
| 4,638,468 | 1/1987 | Francis | 367/153 |
| 4,737,939 | 4/1988 | Ricketts | 367/158 |
| 5,367,501 | 11/1994 | Kelly et al. | 367/157 |
| 5,389,848 | 2/1995 | Trzaskos | 310/322 |
| 5,530,683 | 6/1996 | Lindberg | 367/164 |

*Primary Examiner*—J. Woodrow Eldred

*Attorney, Agent, or Firm*—Michael J. McGowan; William F. Eipert; Prithvi C. Lall

[57] ABSTRACT

A sonar array uses multiple acoustically transparent layers. One layer is a planar array of acoustic sensors that is substantially acoustically transparent. Another layer is an acoustically transparent wiring assembly that provides electrical connection to each acoustic sensor. A third acoustically transparent layer is a planar array of signal processing circuits coupled to the wiring assembly for processing electrical signals generated by the acoustic sensors. Each signal processing circuit resides within an area that is in geometric correspondence with a respective one acoustic sensor. Each signal processing circuit can include a preamplifier, an analog-to-digital converter and a digital multiplexer.

19 Claims, 1 Drawing Sheet

MULTI-LAYER ACOUSTICALLY TRANSPARENT SONAR ARRAY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to sonar arrays, and more particularly to a multi-layer sonar array that is acoustically transparent.

(2) Description of the Prior Art

Sonar systems for most small underwater vehicles currently in use were designed to operate in open water environments, and the performance of these systems is reduced in the acoustic conditions encountered in shallow water environments. Detection and classification of objects in shallow water requires a system which provides significantly more acoustic resolution than is available with many of the current systems in use. To increase resolution to a significant degree, it is necessary to operate at frequencies which are considerably higher than those currently used in most systems for small underwater vehicles. The number and size of the sensors required to operate at these higher frequencies call for dual-frequency systems having multiple arrays, one designed for lower frequencies such as those currently in use and one designed for the higher frequencies needed for shallow water environments.

One such dual-frequency sonar system is disclosed in Kelly et al., U.S. Pat. No. 5,367,501, where a mid-frequency transducer array is employed in the forward end of a submersible vehicle. Between the mid-frequency array and a nose portion of the submersible vehicle is a single or multiple board piezoelectric polymer array employed to implement a high-frequency transducer array. Amplifying and/or signal conditioning units for the high-frequency array are either embedded in the mid-frequency array or are built into the metallic conducting layer of the high-frequency array. In either case, a high-impedance mismatch is created between the structure and the water environment in which an incoming acoustic wave is traveling. This mismatch causes attenuation of the acoustic energy that is to be measured. Additionally, incorporating this system into existing sonar systems often requires substantial and expensive modification to the existing sonar system.

Thus, what is needed a sonar array that is sensitive to a wide range of frequencies and which can be easily adapted to operate with existing sonar systems currently in use.

SUMMARY OF THE INVENTION

Accordingly, it is an object of the present invention to provide a sonar array that is sensitive to multiple frequencies.

Another object of the present invention is to provide a sonar array that can be mounted on an existing sonar array and operate at a different frequency than the existing sonar array without affecting performance thereof.

These and other objects and advantages of the present invention will become more obvious hereinafter in the specification and drawings. In accordance with the present invention, a sonar array has multi-layers which can be mounted on the face of a sonar array operating at a first frequency. One layer is a planar array of acoustic sensors that is substantially acoustically transparent to the first frequency and sensitive to a second frequency. Another layer is an acoustically transparent wiring assembly that provides electrical connection to each acoustic sensor. A third acoustically transparent layer is a planar array of signal processing circuits coupled to the wiring assembly for processing electrical signals generated by-the acoustic sensors. Each signal processing circuit resides within an area that is in geometric correspondence with a respective one acoustic sensor. The planar array of signal processing circuits is embedded in an embedding material that is acoustically matched to water. Each signal processing circuit can include a preamplifier, an analog-to-digital converter and a digital multiplexer. The construction minimizes the number of leads and minimizes lead lengths to keep distortion low.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views of the drawings and wherein.

DESCRIPTION OF THE PREFERRED EMBODIMENT

Figure 1:
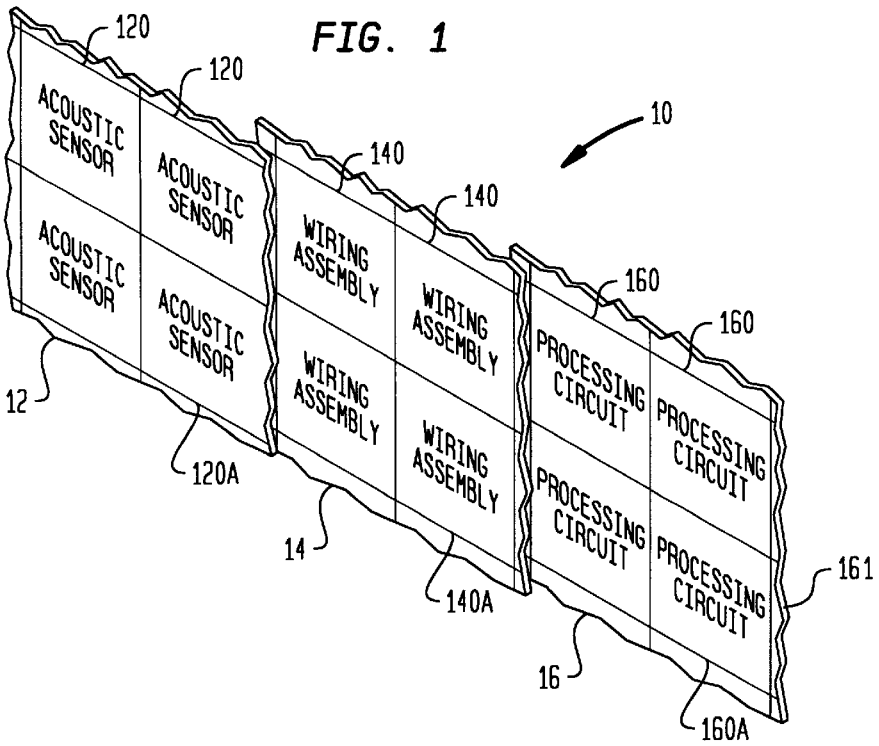
FIG. 1 is an exploded schematic of the multi-layer, acoustically transparent sonar array according to the present invention.

Referring now to the drawings, and more particularly to FIG. 1, a multi-layer sonar array according to the present invention is shown in an exploded view and is referenced generally by numeral 10. Sonar array 10 consists of a planar array 12 of acoustic sensors 120, a planar array 14 of wiring assemblies 140 and a planar array 16 of signal processing circuits 160. When bonded together in accordance with methods well known in the art, sonar array 10 forms an acoustically transparent sonar array that can be used separately or in combination with another transducer array as will be explained further below.

Planar array 12 is fabricated from an acoustic transduction material that is also acoustically transparent to frequencies of interest. For example, in submersible vehicle applications, acoustic transparency up to approximately 200 kHz is desirable. One suitable material satisfying this criteria is polyvinylidene fluoride (PVDF) when used in thicknesses between approximately 40–100 mils. Unfortunately, a disadvantage of using PVDF in acoustic sensor arrays is the resulting low value of sensor capacitance especially at higher frequencies where sensor area becomes small. For example, a PVDF sensor operating at 60 kHz has a sensor area of 0.19 square inches and a capacitance of 42 picofarads while a PVDF sensor operating at 87 kHz has an sensor area of only 0.09 square inches and a capacitance of only 20 picofarads. To minimize losses in receive sensitivity, it is necessary to minimize wire lead lengths between the PVDF sensors (e.g., sensors 120) and their preamplifiers and other signal processing circuitry. Longer lead lengths increase phasing, noise and cross-talk problems.

In the present invention, lead lengths are reduced by providing signal processing circuits in close proximity to planar array 12. More specifically, a signal processing circuit 160 is provided for each acoustic sensor 120. Each signal processing circuit 160 further is confined to an area that is geometrically bound or in correspondence with the geometric bounds of its respective acoustic sensor 120. For example, the geometric area of acoustic sensor 120A defines the area that will be used to contain the corresponding signal processing circuit 160A. This direct electronic and geometric correspondence minimizes lead lengths in the present invention.

Figure 2:
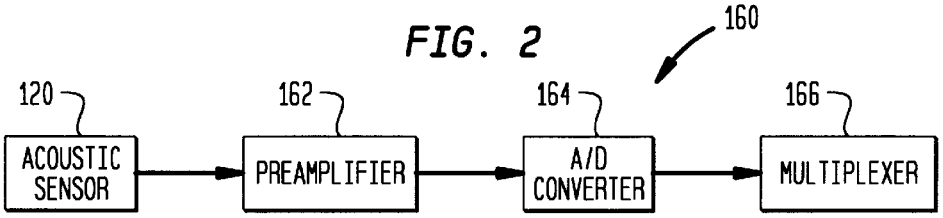
FIG. 2 is a schematic representation of one embodiment of a signal processing circuit embedded within one of the layers of the sonar array.

At a minimum, each signal processing circuit 160 includes a preamplifier. However, as shown by way of example in FIG. 2, each signal processing circuit 160 could incorporate a preamplifier 162 (receiving the output of a corresponding sensor 120) and an analog-to-digital (A/D) converter 164 to create a digital sensor output. Once in digital form, the sensor output could further be multiplexed at multiplexer 166. The digitally multiplexed output reduces the wiring required to couple sonar array 10 to any further signal processing electronics (not shown). Also, because the sensor output is digitized, subsequent electronics can simply utilize digital processors thereby eliminating the need for special purpose electronics or filtering.

To make planar array 16 acoustically transparent, each circuit element of signal processing circuits 160 is selected to be much smaller (e.g., less than one-fifteenth) than the wavelength of the signal under consideration. Further, signal processing circuits 160 are embedded in a material that is acoustically transparent. This is achieved by selecting an embedding material 161 that is acoustically matched to the environment in which acoustic pressures are to be sensed. For submersible vehicle applications, embedding material 161 should therefore be acoustically matched to water. A good acoustic match with water is achieved by using a material having density and speed of sound transmission characteristics that are each closely matched to that of water. Accordingly, a good choice for embedding material 161 is any one of a variety of elastomeric polymers used as potting compounds.

To electrically couple each acoustic sensor 120 to its corresponding signal processing circuit 160, array 14 is interposed between planar arrays 12 and 16. Array 14 is a flex-circuit wiring layer on the order of 5–20 mils in thickness. Wiring within each wiring assembly 140 is also confined to an area that is geometrically bound or in correspondence with the geometric bounds of its respective acoustic sensor 120. For example, the geometric area of acoustic sensor 120A defines the area that will be used to contain the corresponding wiring assembly 140A.

Figure 3:
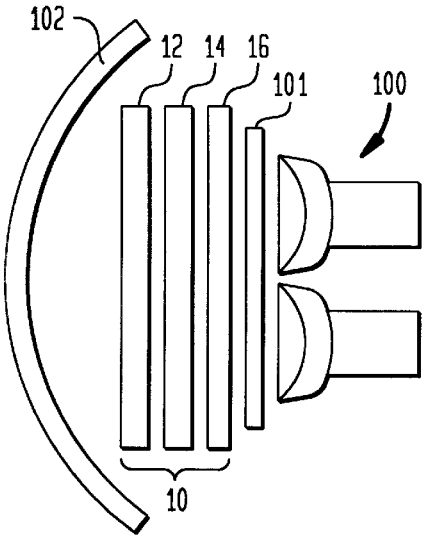
FIG. 3 is side view of the sonar array of the present invention as it would be installed over an underlying acoustic array to form a dual-frequency sonar array.

The transparency feature of the present invention is particularly useful when it is desired to install sonar array 10 directly over an underlying active or passive acoustic array (operating at a different frequency) without affecting the acoustic performance of the underlying array. For example, submersible vehicles frequently have a Tonpilz-type acoustic array or other piezoceramic acoustic array mounted in the nose thereof. In FIG. 3, a portion of a Tonpilz-type array is referenced by numeral 100. The elements of the multi-layer sonar array 10 are identified with the same reference numerals as used above. Since Tonpilz array 100 is typically covered with an elastomeric, acoustically transparent sheet 101, a strong bond can be readily formed between embedding material 161 (used in planar array 16) and sheet 101 in accordance with methods well known in the art. A protective acoustically transparent window sheet 102 can be bonded over the face of planar array 12 to protect same.

The advantages of the present invention are numerous. By providing dedicated signal processing circuits for each sensor within the sensor's footprint and essentially immediately adjacent thereto, lead lengths are minimized thereby improving overall performance. The high frequency passive sonar array design can be used by itself or in combination with an underlying acoustic array. The transparent nature of the present invention allows an underlying array to operate in its transmit or receive mode without any degradation in performance. Thus, the present invention will find great utility as an "add-on" feature for existing submersible vehicles.

Figure 4A:
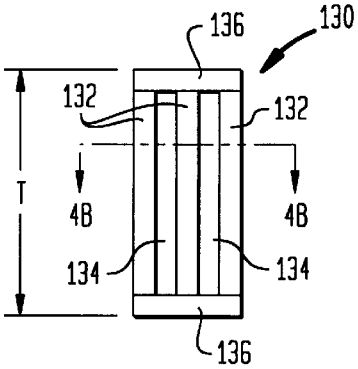
FIG. 4A is a side view of a 1–3 composite structure for use as an alternative acoustic sensor in the present invention.
Figure 4B:
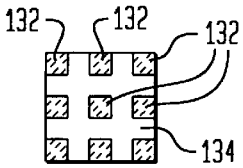
FIG. 4B is a cross-sectional view of the 1–3 composite structure taken along line 4—4 in FIG. 4A.

Although the present invention has been described relative to specific embodiments thereof, it is not so limited. For example, each acoustic sensor 120 could also be realized by a 1–3 composite structure 130 such as that shown in FIGS. 4A and 4B. Composite structure 130 consists of a plurality (e.g., nine are shown) of longitudinally polarized ceramic bars (e.g., PZT-5H available commercially from EDO Acoustic Products, Salt Lake City, Utah) 132 separated from one another by, as indicated at 134, air or an elastomeric polymer material. Either end of structure 130 is capped by a copper clad board 136. As with previously described embodiments, the thickness T of structure 130 is small enough to achieve acoustic transparency. Further, the geometric boundary defined by the footprint depicted in FIG. 4B defines the boundaries of the corresponding wiring assembly and signal processing circuits.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A sonar apparatus having multi-layers for mounting on the face of a sonar array operating at a first frequency, comprising:

a planar array of acoustic sensors that is substantially acoustically transparent to said first frequency and sensitive to a second frequency;

an acoustically transparent wiring assembly for providing electrical connection to each of said acoustic sensors while remaining acoustically transparent to at least said first frequency;

a planar array of signal processing circuits coupled to said wiring assembly for processing electrical signals generated by said planar array of acoustic sensors, each of said signal processing circuits residing within an area that is in geometric correspondence with a respective one acoustic sensor from said planar array of acoustic sensors; and a material that is acoustically matched to water for embedding therein said planar array of signal processing circuits.

2. A sonar apparatus as in claim 1 wherein said wiring assembly is sandwiched between said planar array of acoustic sensors and said planar array of signal processing circuits.

3. A sonar apparatus as in claim 1 wherein each of said acoustic sensors is a polyvinylidene fluoride (PVDF) sensor.

4. A sonar apparatus as in claim 3 wherein each said PVDF sensor is approximately 40–100 mils in thickness.

5. A sonar apparatus as in claim 1 wherein each of said acoustic sensors is a 1–3 composite structure.

6. A sonar apparatus as in claim 1 wherein each of said signal processing circuits includes a preamplifier for amplifying said electrical signals generated by a corresponding one of said acoustic sensors.

7. A sonar apparatus as in claim 6 wherein each of said signal processing circuits further comprises:

an analog-to-digital converter for converting said electrical signals to a digital format; and a digital multiplexer for multiplexing said electrical signals so-converted to said digital format.

8. A sonar apparatus as in claim 1 wherein said multi-layers are arranged such that said planar array of acoustic sensors receives an incoming pressure wave before said wiring assembly and said planar array of signal processing circuits.

9. A sonar apparatus comprising:

a planar array of acoustic sensors fabricated from a layer of acoustic material that is substantially acoustically transparent to frequencies below approximately 200 kHz;

an acoustically transparent wiring assembly layer acoustically transparent to said frequencies below approximately 200 kHz, said acoustically transparent wiring assembly layer mounted adjacent said planar array of acoustic sensors for providing electrical connection to each of said acoustic sensors;

a planar array of signal processing circuits mounted adjacent said wiring assembly layer and electrically coupled thereto for processing electrical signals generated by said planar array of acoustic sensors, each of said signal processing circuits residing within an area that is in geometric correspondence with a respective one acoustic sensor from said planar array of acoustic sensors;

a layer of embedding material having density and speed of sound characteristics that are similar to that of water for embedding therein said planar array of signal processing circuits; and a sonar array having a planar face and operating at a frequency below approximately 200 kHz, said planar face being covered with an elastomeric material, wherein said embedding material is bonded to said elastomeric material.

10. A sonar apparatus as in claim 9 wherein said acoustic material is polyvinylidene fluoride (PVDF).

11. A sonar apparatus as in claim 10 wherein said layer of acoustic material is approximately 40–100 mils in thickness.

12. A sonar apparatus as in claim 9 wherein each of said signal processing circuits includes a preamplifier for amplifying said electrical signals generated by said respective one acoustic sensor.

13. A sonar apparatus as in claim 12 wherein each of said signal processing circuits further comprises:

an analog-to-digital converter for converting said electrical signals to a digital format; and a digital multiplexer for multiplexing said electrical signals so-converted to said digital format.

14. A sonar apparatus as in claim 9 further comprising a layer of acoustically transparent material covering said planar array of acoustic sensors wherein said planar array of acoustic sensors are sandwiched between said layer of acoustically transparent material and said wiring assembly layer.

15. A sonar apparatus as in claim 9 wherein said sonar array comprises a Tonpilz-type sonar array.

16. A sonar apparatus as in claim 9 wherein said sonar array comprises a piezoelectric ceramic-type sonar array.

17. A sonar apparatus as in claim 9 wherein said sonar array is an active sonar array.

18. A sonar apparatus as in claim 9 wherein each said respective one acoustic sensor is a passive acoustic sensor.

19. A sonar apparatus having multi-layers for mounting on the face of a sonar array operating at a first frequency, comprising:

a planar array of acoustic sensors that is substantially acoustically transparent to said first frequency and sensitive to a second frequency;

a flex-circuit wiring layer between approximately 5–20 mils in thickness for providing electrical connection to each of said acoustic sensors;

a planar array of signal processing circuits coupled to said wiring layer for processing electrical signals generated by said planar array of acoustic sensors, each of said signal processing circuits residing within an area that is in geometric correspondence with a respective one acoustic sensor from said planar array of acoustic sensors; and a material that is acoustically matched to water for embedding therein said planar array of signal processing circuits.

* * * * *